US006109963A

United States Patent [19]

Follingstad et al.

[11] Patent Number: 6,109,963

[45] Date of Patent: Aug. 29, 2000

[54] REPAIRABLE CONNECTOR AND METHOD

[75] Inventors: Michael Jay Follingstad, Edina; Jeffrey Louis Peters, Eagan, both of Minn.

[73] Assignee: ADC Telecommunications, Inc., Minnetonka, Minn.

[21] Appl. No.: 09/357,025

[22] Filed: Jul. 20, 1999

Related U.S. Application Data

[62] Division of application No. 09/007,855, Jan. 15, 1998, Pat. No. 5,967,852.

[51] Int. Cl.[7] ..... H01R 9/05

[52] U.S. Cl. ..... 439/578

[58] Field of Search ..... 439/578, 675, 439/579–585, 879, 746–748, 608, 610

[56] References Cited

U.S. PATENT DOCUMENTS

| | | | |
|---|---|---|---|
| 3,673,546 | 6/1972 | Green . | |
| 4,358,174 | 11/1982 | Dreyer . | |
| 4,813,887 | 3/1989 | Capp . | |
| 5,498,175 | 3/1996 | Yeh et al. | 439/578 |
| 5,620,339 | 4/1997 | Gray et al. | 439/578 |
| 5,993,253 | 11/1999 | Sai | 439/578 |

FOREIGN PATENT DOCUMENTS

| | | |
|---|---|---|
| 0 284 320 A2 | 9/1988 | European Pat. Off. . |
| 0 459 663 A1 | 12/1991 | European Pat. Off. . |
| 0 577 277 A1 | 1/1994 | European Pat. Off. . |

OTHER PUBLICATIONS

Exhibit A ADC Telecommunications catalog page entitled "BNC Right Angle and BNC Connectors," dated Nov. 1996.

Exhibit B Kings Electronics Co. Inc. catalog pages—front cover page, pp. 1, 36, 38, 41, 50, 51, and back cover page, dated 1991.

*Primary Examiner*—Renee Luebke
*Assistant Examiner*—Antoine Ngandjui
*Attorney, Agent, or Firm*—Merchant & Gould P.C.

[57] ABSTRACT

A repairable transmission line connector is provided where the center conductor has a front removable portion, and a rear portion crimped to the center conductor of the transmission cable. An outer sleeve mounted to a first coaxial conductor of the cable includes a removable front portion, and a rear portion crimped to the first coaxial conductor of the cable. An insulator holds the front center conductor wherein the insulator is held by the rear outer sleeve and the front outer sleeve. The front and rear outer sleeves, and the front and rear center conductors form a connector assembly. In a triaxial connector the connector assembly is surrounded by an insulating sleeve disposed within front and rear connector bodies connected to the cable. By disconnecting the front and rear connector bodies (if present) and the front and rear outer sleeves, access to the front center conductor is permitted for replacement of the front center conductor. The front outer sleeve and the insulator can be replaced as desired.

8 Claims, 8 Drawing Sheets

REPAIRABLE CONNECTOR AND METHOD

This application is a Divisional of application Ser. No. 09/007,855, filed Jan. 15, 1998, now U.S. Pat. No. 5,967,852 which application(s) are incorporated herein by reference.

FIELD OF THE INVENTION

The present invention relates to transmission line connectors for triaxial and coaxial cables.

BACKGROUND OF THE INVENTION

Both coaxial and triaxial transmission cables include a center conductor (solid or stranded) surrounded by one layer (in the case of coax) or two layers (in the case of triax) of braided shielding conductor. Dielectric layers are between the conductors, and an outer protective jacket surrounds the inner layers. Connectors link the various conductors of the cables to transmission equipment or other cables. The cable connectors can be disconnected and reconnected as desired. The connectors usually include a small projecting male or female center conductor made of copper or other conductive material for connecting to the center conductor of the transmission equipment or other cables.

Triaxial connectors can be used for connecting the cables to television broadcasting and video equipment, such as for connecting the camera head to the camera control-unit. Other uses of the cables and connectors include providing DC power to the camera, intercom to operator connections, teleprompter feeds, and robotic camera functions.

The center conductor portion of the connector is fairly fragile and prone to damage. The center conductor portion can become damaged if the connector is misaligned during a connection to transmission equipment. A problem arises if the center conductor portion becomes damaged. In the past, the connector was permanently attached to the cable, such as via crimping. The cable had to be recut and a new connector installed when the center conductor of the connector was damaged. Recutting and installing a new connector in the field is a time consuming task. There is a need for connectors and methods which allow faster repair when the center conductor portion or other front portion of the connector becomes damaged.

SUMMARY OF THE INVENTION

The present invention concerns a repairable connector including a rear center conductor connectable at a rear end to a center conductor of a cable. A front end of the rear center conductor defines a center conductor tip. Preferably, the center conductor tip defines a male tip. A rear outer sleeve of the connector is connectable to a first coaxial conductor of the cable at a rear end of the rear outer sleeve. The rear outer sleeve also includes a front end. A front outer sleeve of the connector includes a rear end for releasably mounting to the rear outer sleeve. Threads are one preferred structure for permitting releasable mounting. An insulator is held by the front and rear outer sleeves. A front center conductor of the connector includes a rear end mounted to the center conductor tip of the rear center conductor. The front center conductor is further held by the insulator. A front end of the front center conductor defines a connecting portion for use in connecting to the center conductor of the camera or other transmission equipment or another cable. Also, the front end of the front outer sleeve defines a connecting portion for use in connecting to coaxial conductor of the camera or other transmission equipment, or another cable.

The front outer sleeve is removable from the rear outer sleeve so as to replace the front outer sleeve, or to access the insulator and the front center conductor, in order to replace the front center conductor or the insulator or both, as desired.

The insulator is preferably ring-shaped and is preferably comprised of split halves which can be assembled around the front center conductor. The front center conductor at the front end can either be a male conductor portion or a female conductor portion. Similarly, the front end of the front outer sleeve has a corresponding male or female sleeve portion.

A connector body including an insulating sleeve may house the front and rear center conductors, the insulator, and the front and rear outer sleeves as desired, such as in the case of a triaxial connector. Preferably, the connector body includes front and rear portions threadably mounted to each other, and where the rear portion is connectable to a second coaxial conductor of the cable.

The present invention also relates to a connector repair kit including a front outer sleeve including a threaded end, an insulator received within the front outer sleeve, and a front center conductor held by the insulator. The front outer sleeve is threadably mountable to a rear outer sleeve mounted to a coaxial conductor of the cable. The center conductor is slidably mounted to a rear center conductor mounted to a center conductor of the cable.

The present invention also relates to a center conductor for use as a replacement connector part where the center conductor has a longitudinal axis, first and second ends, and a central region. The central region defines a reduced diameter portion and two opposed radial shoulders. The first end defines a female center conductor tip. The second end forms the center conductor tip of the connector and can either be a female center conductor tip or a male center conductor tip.

The present invention also relates to a method of assembly of a transmission line connector including the step of providing a cable and a rear portion of a connector mounted to the cable wherein the rear portion of the connector includes a rear center conductor and a rear outer sleeve. The method further comprises sliding a front center conductor onto the rear center conductor, and mounting a front outer sleeve to the rear outer sleeve wherein an insulator surrounds the front center conductor and is trapped between a shoulder of the front outer sleeve, and a shoulder of the rear outer sleeve.

The method also preferably includes repairing the connector by removing the front outer sleeve, and removing the front center conductor, and sliding a second front center conductor onto the rear center conductor. The method also comprises mounting the front outer sleeve or a new front outer sleeve to the rear outer sleeve wherein an insulator, new or original, associated with the second front center conductor is trapped between the shoulders of the front and rear outer sleeves, respectively.

The method also preferably includes crimping the rear center conductor to the center conductor of the cable, and crimping the rear outer sleeve to the shielding conductor of the cable.

Preferably, the method includes providing a connector body in a triaxial connector including an insulating sleeve housing the front and rear center conductors, the insulator, and the front and rear outer sleeves. Preferably, the connector body includes front and rear portions threadably mounted to each other, and where the rear portion is connectable to a second shielding conductor of the cable. The method further preferably includes the step of removing the front portion of the connector body from the rear portion to access the front and rear outer sleeves for repair of the connector.

DETAILED DESCRIPTION OF THE PREFERRED EMBODIMENTS

Figure 1:
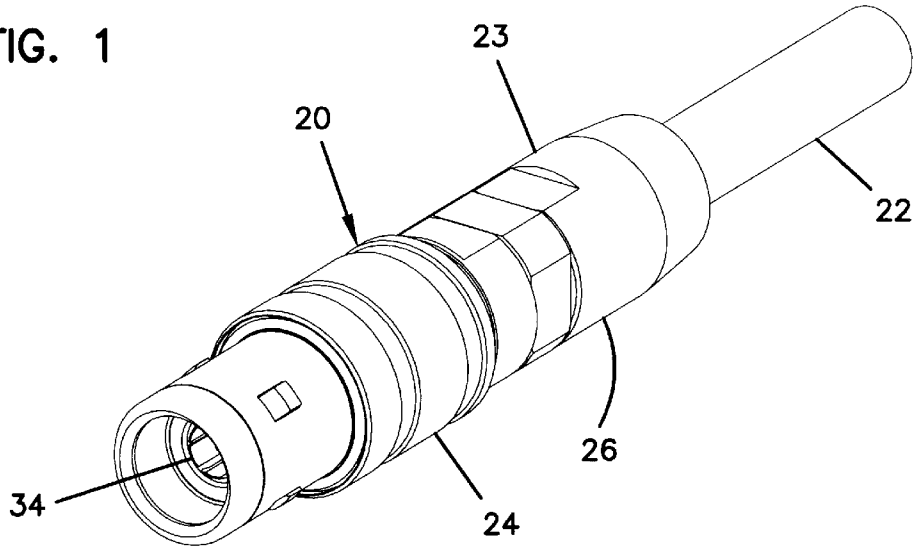
FIG. 1 is a perspective view of a triaxial male connector mounted to a cable according to one preferred embodiment of the present invention.
Figure 2:
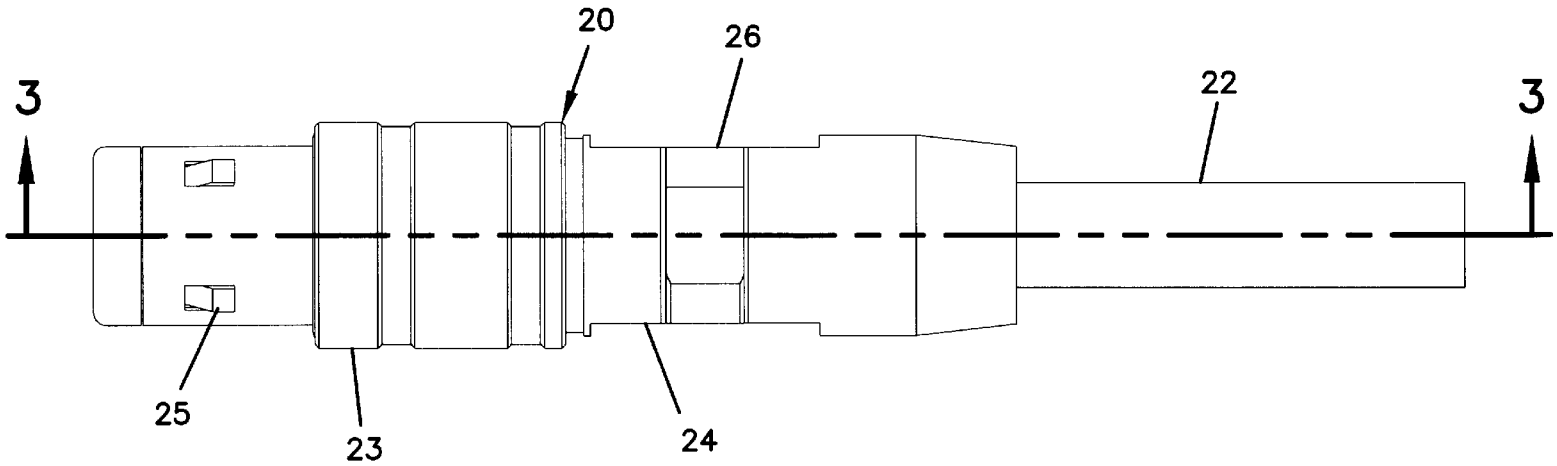
FIG. 2 is a side view of the connector and cable of FIG. 1.

A first preferred embodiment of a triaxial camera connector 20 is shown in FIGS. 1–10. Connector 20 is a male connector for connecting to a female triaxial connector of a triaxial camera or other transmission equipment or cable. A second preferred embodiment of a triaxial camera connector 200 is shown in FIGS. 11–16 and includes a female connector for connecting to a male triaxial connector of a triaxial camera or other transmission equipment or cable.

Referring again to FIGS. 1–10, connector 20 mounts to a transmission cable 22 and includes a male outer connector body 23 including a front connector body 24 releasably mounted to a rear connector body 26 which is mounted to cable 22. Inner threads 28 of front connector body 24 threadably engage outer threads 30 of rear connector body 26 to enable convenient assembly and disassembly.

An inner insulating sleeve 32 insulates front and rear connector bodies 24, 26 from a male inner connector assembly 34. Front and rear connector bodies 24, 26 and sleeve 32 are of conventional construction or other constructions as desired to house inner connector assembly 34. Example material for connector bodies 24, 26 is brass, and example material for sleeve 32 is Teflon™ material. Connector body 23 preferably includes releasable latching structure 25 for selectively latching connector 20 to reciprocal structure. An example reciprocal structure is connector body 223 of connector 200 shown in FIGS. 11–13. Connector body 23 also provides a ground pathway for cable 22.

Inner connector assembly 34 includes two conductor transmission pathways for connector 20. Inner connector assembly 34 conveniently assembles and disassembles to allow replacement of components of inner connector assembly 34, as will be described below.

Figure 3:
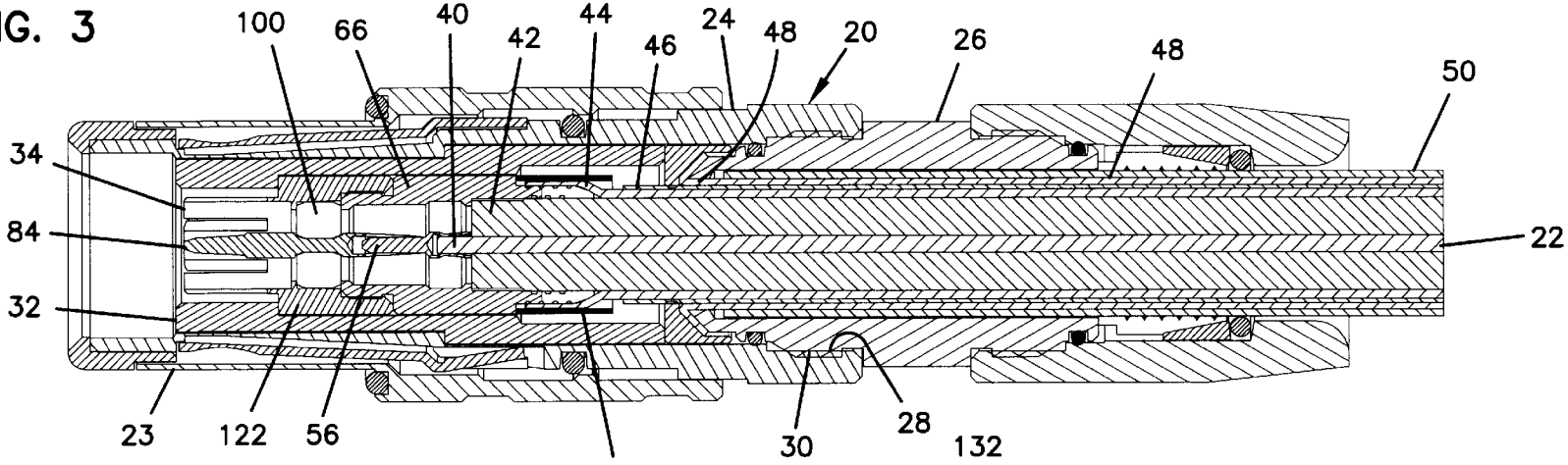
FIG. 3 is a cross-sectional top view of the connector and cable of FIG. 1 along lines 3—3 of FIG. 2.

Cable 22 includes a center conductor 40 defining a first transmission path surrounded by a first insulating layer 42. A first concentric conductor 44 provides a second transmission path through the cable. A further insulating layer 46 surrounds the first concentric conductor 44. A second concentric conductor 48 provides a third transmission path through the cable, such as ground. As shown in FIG. 3, an end of second concentric conductor 48 is clamped to rear connector body 24. An outer jacket 50 protects the inner components of cable 22.

Referring now to FIGS. 3–10, inner connector assembly 34 of connector includes a rear center conductor 56, a rear outer sleeve 66 with a crimping sleeve 80, a front center conductor 84, an insulator 100, and a front outer sleeve 122. Front and rear center conductors 84, 56 are made of electrically conductive material and assemble to form the center conductor transmission pathway of inner connector assembly 34. Front and rear outer sleeves are made of electrically conductive material and assemble to form a second transmission pathway of inner connector assembly 34. The center conductor pathway and the second transmission pathway of the outer sleeves are insulated from one another by insulator 100.

Figure 4:
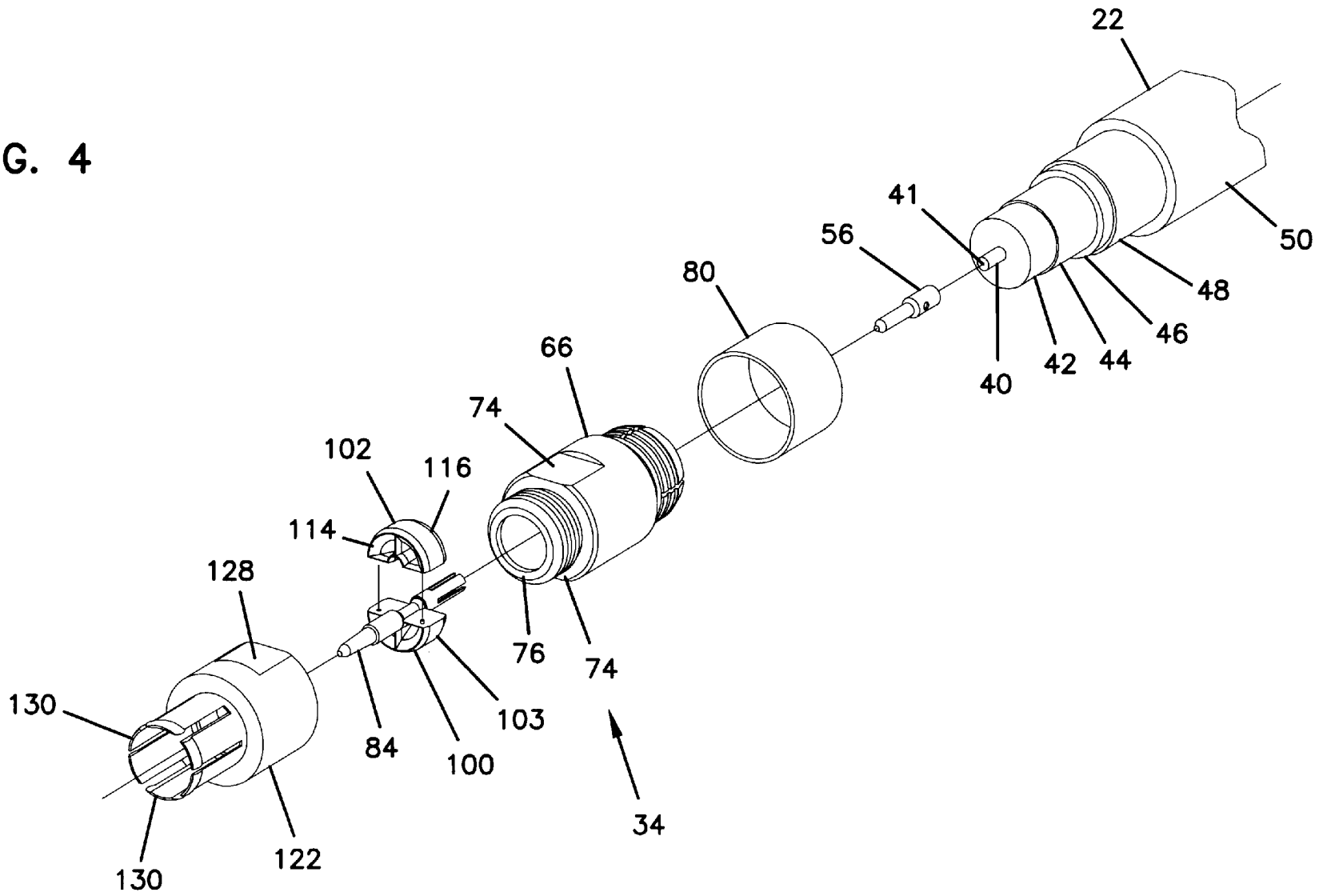
FIG. 4 is an exploded perspective view of the inner connector assembly of the connector of FIG. 1 and the cable.
Figure 7:
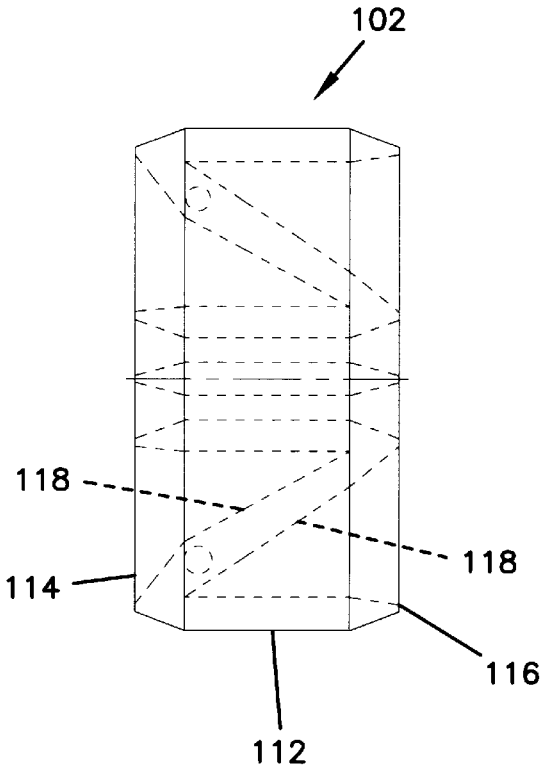
FIG. 7 is a side view of one of the insulating ring halves of the connector of FIG. 1.
Figure 8:
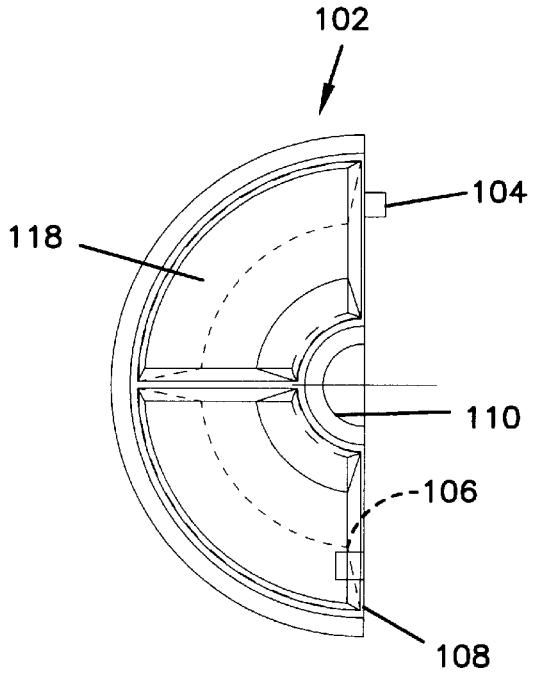
FIG. 8 is an end view of the insulating ring half of FIG. 7.
Figure 10:
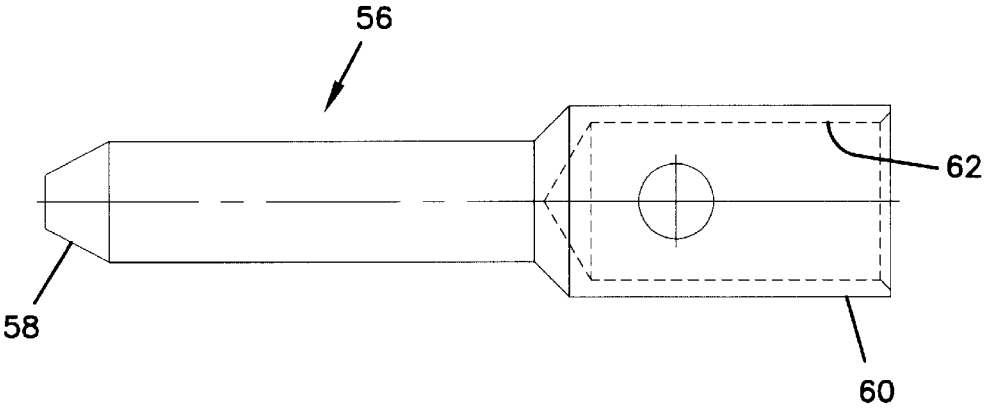
FIG. 10 is a side view of the rear center conductor of the connector of FIG. 1.

Rear center conductor 56 shown in FIGS. 3, 4 and 10 includes a male end or tip 58, and a female end 60 crimped to center conductor 40 of cable 22 where an end 41 of center conductor 40 projects into a center recess 62 of rear center conductor 56. One example material for rear center conductor 56 is brass alloy C360. If desired, rear center conductor 56 can have a female tip instead of male tip 58.

Figure 9:
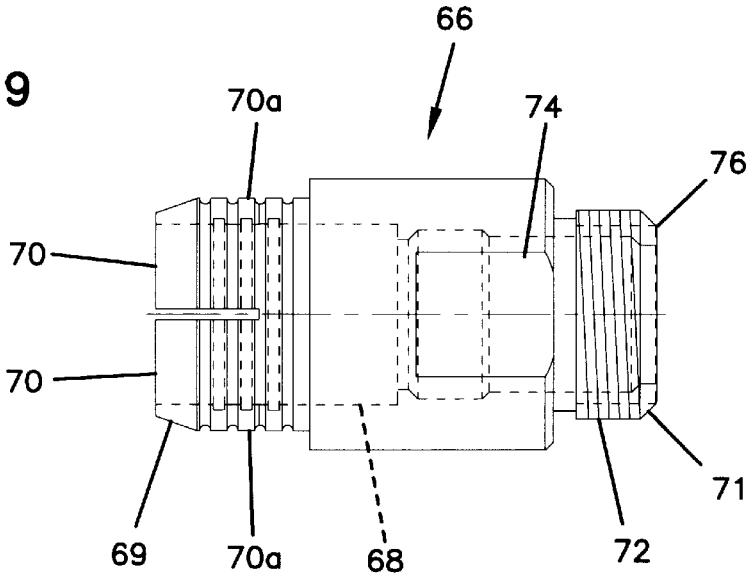
FIG. 9 is a top view of the rear outer sleeve of the connector of FIG. 1.

Rear outer sleeve 66 shown in FIGS. 3, 4 and 9 is also crimped to cable 22 during use. A central passage 68 of rear outer sleeve 66 extends from one end 69 of rear outer sleeve 66 to the opposite end 71. Projecting fingers 70, including an undulating outer surface 70*a* and a crimping sleeve 80 permit crimping of rear outer sleeve 66 to an end first concentric conductor 44 as shown in FIG. 3. FIG. 4 shows crimping sleeve 80 prior to crimping. Rear outer sleeve 66 can be made of brass alloy C360, and crimping sleeve 80 can be made of annealed brass alloy C360, for example.

Opposite end 71 of rear outer sleeve 66 includes outer threads 72 projecting toward a front end of connector 20. Rear outer sleeve 66 also includes opposed flat portions 74 on an outer surface for use in holding rear outer sleeve 66 by hand or with a tool (wrench, for example) during assembly or disassembly. Alternatively, rear outer sleeve can include a knurled gripping surface to facilitate assembly and disassembly. An end shoulder 76 projects toward the front end of connector 20.

Figure 6:
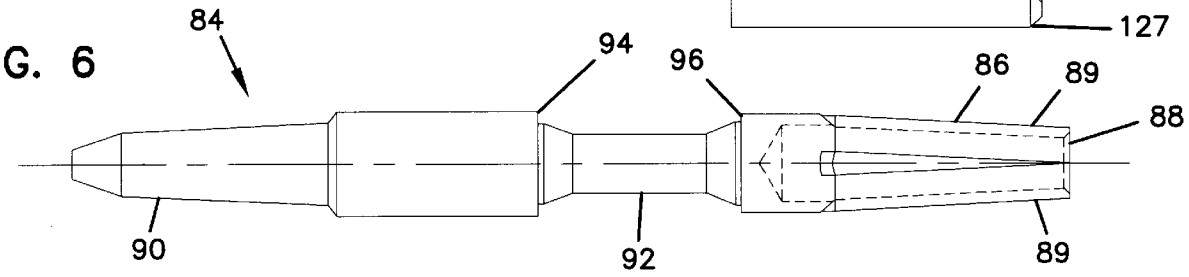
FIG. 6 is a top view of the front center conductor of the connector of FIG. 1.

Front center conductor 84 shown in FIGS. 3, 4 and 6 includes a female end or tip 86 with a center recess 88 for slidably mounting to male end 58 of rear center conductor 56. FIG. 6 shows fingers 89 in an inwardly crimped condition prior to being inserted over male end 58. A male end would be needed if rear center conductor 56 included a female end. Front center conductor 84 further includes an opposite male end or tip 90 which forms the connection end of connector 20. Front center conductor 84 includes a reduced diameter central portion 92 defining front and rear radial shoulders 94, 96. One example material for front center conductor 84 is heat treated beryllium copper, specifically ASTM B194 UNS C172 alloy, heat treated to a finish temper of TH02, and Rockwell hardness on a C-scale of 38–44.

Insulator 100 shown in FIGS. 3, 4, 7 and 8 holds front center conductor 84. A center portion of insulator 100 resides in reduced diameter central portion 92 of front center conductor 84. Insulator 100 is further trapped between front and rear radial shoulders 94, 96. Preferably, insulator 100 defines a ring shape and is formed by identical halves 102, 103. A description of half 102 applies to half 103. Half 102 includes a projecting post 104 and a recess 106 along diametral planar portion 108. Post 104 resides in recess 106 of half 103, and recess 106 receives post 104 of half 103. Half 102 defines a central passage 110 for receipt of reduced diameter central portion 92 of front center conductor 84.

Insulator 100 includes an outer rim 112 including a front rim portion 114 and a rear rim portion 116. Insulator 100 of the preferred embodiment further includes various angled surfaces 118 for reducing reflection of transmission signals during use. Example materials for insulator 100 include UlteM™ material by General Electric or Teflon™ material. Other shapes for insulator 100 including tubular, are possible.

Figure 5:
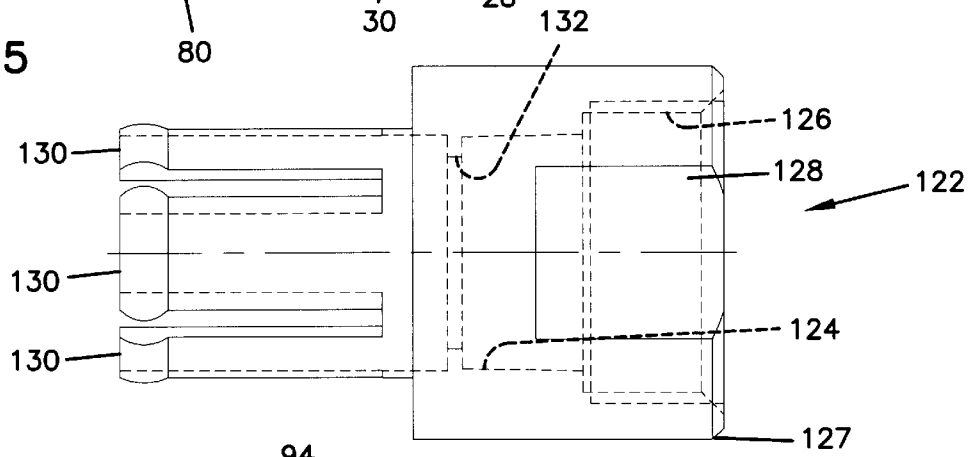
FIG. 5 is a top view of the front outer sleeve of the connector of FIG. 1.

Front outer sleeve 122 shown in FIGS. 3–5 defines a central passage 124 including inner threads 126 at one end 127, and a plurality of longitudinally projecting fingers 130 at an opposite end 129. Fingers 130 define a male connector sleeve such as of the type in a conventionally shaped connector end for connecting to a reciprocal female connector. Inner threads 126 threadably mount to outer threads 72 of rear outer sleeve 66. Two flat portions 128 on opposite sides of an outer surface of front outer sleeve 122 permit grasping by hand or a tool during assembly and disassembly of front and rear outer sleeves 122, 66. Alternatively, a knurled griping surface can be provided. An inner shoulder 132 cooperates with front shoulder 76 of rear outer sleeve 66 to trap outer rim 112 of insulator 100 where front rim portion 114 is adjacent to inner shoulder 132 and rear rim portion is adjacent to front shoulder 76. An example material for front outer sleeve 122 is brass alloy C360.

Once assembled, connector 20 is conveniently repaired if one or both of front center conductor 84 or front outer sleeve 122 becomes damaged. By removing front connector body 24 from rear connector body 26 and unscrewing front outer sleeve 122 from rear outer sleeve 66, front outer sleeve 122 can be replaced with a new part. Also, by unscrewing front outer sleeve 122, access to front center conductor 84 is possible so as to remove front center conductor 84 and replace it with a new front center conductor. Insulator 100 can be reused, or a new insulator can be added at the same time. By sliding female end 86 of the new front center conductor 84 over rear center conductor 56, connector 20 with a damaged center conductor can be repaired without having to recut cable 22 and reattach a new connector.

Other releasable mounting structures between front and rear outer sleeves 122, 66 besides threads are possible to allow replacement of front outer sleeve 122 or to allow replacement of front center conductor 84 and insulator 100, such as a snap arrangement, a bayonet and slot arrangement or a longitudinally sliding slip fit arrangement. Releasable mounting structure allows for reuse of the rear portions of the connector 20 (rear center conductor 56 and rear outer sleeve 66) which are permanently crimped to the cable, in the event the front portions of the connector become damaged. Thus, a field repairable connector is provided which allows faster repair of the connector having a damaged front end, since the cable recutting and recrimping operations are avoided.

Referring now to FIGS. 11–16, the female triaxial camera connector 200 is shown including a female outer connector body 223 and a female inner connector assembly 234 including a female front center conductor 284. Rear center conductor 56, rear outer sleeve 66, crimping sleeve 80, and insulator 100 are constructed as in male inner connector assembly 34. Front center conductor 284 includes a similar female end 86 with a center recess 88 for mounting to rear center conductor 56. Instead of a male end 90, front center conductor 284 includes a female end or tip 290. Front center conductor 284 includes the reduced diameter center portion 92 and front and rear shoulders 94, 96. Front center conductor 284 is held in place in a similar manner by insulator 100 trapped between a front outer sleeve 322 and rear outer sleeve 66. Instead of projecting fingers 130, front outer sleeve 322 includes a front cylindrical or tubular portion 330 such as of the type in a conventionally shaped end of a female connector sleeve. Outer connector body 223 of connector 200 includes a front connector body **24*a* and an inner insulating sleeve 30*a* constructed to allow connector 200 to connect to a reciprocal male triaxial connector. Front connector body 24*a* and sleeve 32*a* are of conventional construction or other constructions as desired to house inner connector assembly 234. In the illustrated embodiment, rear connector body 26 is the same as in connector 20**.

Access to repair connector 200 is the same as connector 20 with respect to removing front connector body **24*a*, and then unscrewing front outer sleeve 322 from rear outer sleeve 66 to replace front center conductor 284, and/or front outer sleeve 322 and/or insulator 100. Like connector 20, other releasable mounting structures between front outer sleeve 322 and rear outer sleeve 66** are possible.

The embodiments illustrated in FIGS. 1–16 are for repairable connectors for triaxial cables including various selectively detachable structures to allow repair of a damaged front end of the connector. In the case of coaxial cables, connectors also link the center conductor of the cable and the ground shield of the cable to transmission equipment on other coaxial cables. Coaxial repairable connectors in accordance with the invention include front end rear center conductors, where the rear center conductor is mounted to the center conductor of the cable (i.e., via crimping), and the front center conductor is selectively mountable to the rear center conductor such as in the embodiments noted above. The coaxial connector also includes front and rear outer sleeves where the rear outer sleeve is mounted to the ground shield (i.e., via crimping), and the front outer sleeve is selectively mountable to the rear outer sleeve, such as in the embodiments noted above, or as in other selective mounting arrangements. An insulator holds the front center conductor, and the insulator is held by the front and rear outer sleeves, such as in the embodiments noted above. The coaxial connector may include connecting structure on the outer sleeve(s) so as to permit connection of the connector to reciprocal connectors of the transmission equipment or other cables, such as threads or bayonets and slots.

Having described the present invention in a preferred embodiment, modifications and equivalents may occur to one skilled in the art. It is intended that such modifications and equivalents shall be included within the scope of the claims which are appended hereto.

What is claimed is:

1. A transmission line female connector repair kit mountable to a connector portion mounted to a cable, the cable including a center conductor, and a coaxially extending first conductor surrounding the center conductor, the connector portion including a rear center conductor mounted to the center conductor of the cable, and a rear outer sleeve mounted to the first conductor of the cable, the rear outer sleeve including a threaded front end, and a shoulder, the female connector repair kit comprising:

a front outer sleeve including a threaded rear end threadably mountable to the threaded front end of the rear outer sleeve, the front outer sleeve including an inner shoulder, the front outer sleeve further including a front end defining a tubular portion;

an insulator received within the front outer sleeve and engageable with the inner shoulder, the insulator engageable with the shoulder of the rear outer sleeve; and a front center conductor mounted to the insulator and including a rear end slidably and detachably mountable to the rear center conductor, the front center conductor including a front end defining a female center conductor tip, wherein a female connector is formed when the front outer sleeve, the insulator and the front center conductor are mounted to the connector portion mounted to a cable.

2. The female connector repair kit of claim 1, wherein the insulator has a ring shape, and further includes two identical halves split along a diametral portion of the ring.

3. The female connector repair kit of claim 1, wherein the front outer sleeve includes a non-symmetrical outer gripping surface.

4. The female connector repair kit of claim 3, wherein the non-symmetrical outer gripping surface includes two opposed planar portions.

5. A transmission line male connector repair kit mountable to a connector portion mounted to a cable, the cable including a center conductor, and a coaxially extending first conductor surrounding the center conductor, the connector portion including a rear center conductor mounted to the center conductor of the cable, and a rear outer sleeve mounted to the first conductor of the cable, the rear outer sleeve including a threaded front end, the male connector repair kit comprising:

a front outer sleeve including a threaded rear end threadably mountable to the threaded front end of the rear outer sleeve, the front outer sleeve including an inner shoulder, the front outer sleeve further including a front end defining a plurality of longitudinally projecting fingers;

an insulator received within the front outer sleeve and engageable with the inner shoulder, the insulator engageable with the shoulder of the rear outer sleeve; and a front center conductor mounted to the insulator and including a rear end slidably and detachably mountable to the rear center conductor, the front center conductor including a front end defining a male center conductor tip, wherein a male connector is formed when the front outer sleeve, the insulator and the front center conductor are mounted to the connector portion mounted to a cable.

6. The male connector repair kit of claim 5, wherein the insulator has a ring shape, and further includes two identical halves split along a diametral portion of the ring.

7. The male connector repair kit of claim 5, wherein the front outer sleeve includes a non-symmetrical outer gripping surface.

8. The male connector repair kit of claim 7, wherein the non-symmetrical outer gripping surface includes two opposed planar portions.

* * * * *

UNITED STATES PATENT AND TRADEMARK OFFICE

CERTIFICATE OF CORRECTION

PATENT NO. : 6,109,963
DATED : August 29, 2000
INVENTOR(S) : Follingstad et al.

Figure 13:
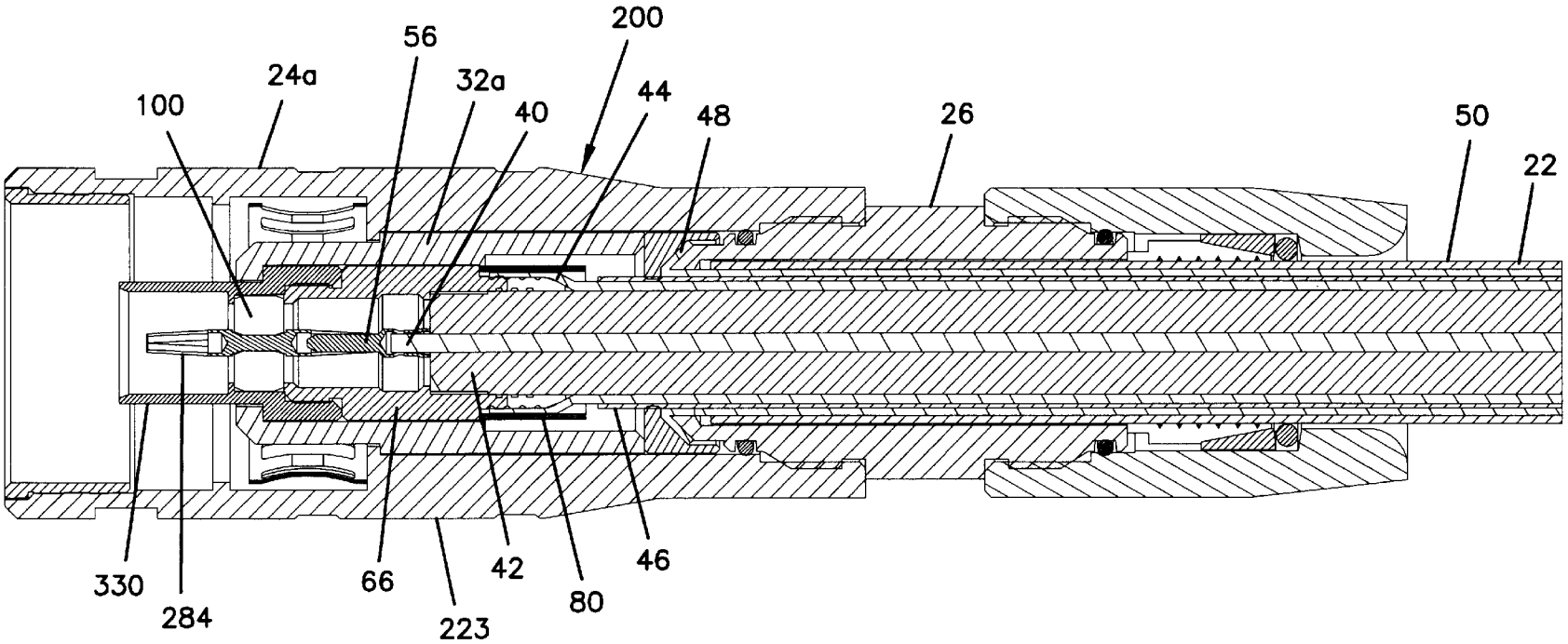
FIG. 13 is a cross-sectional top view of the inner connector assembly and cable of FIG. 11 along lines 13—13 of FIG. 12.
Figure 11:
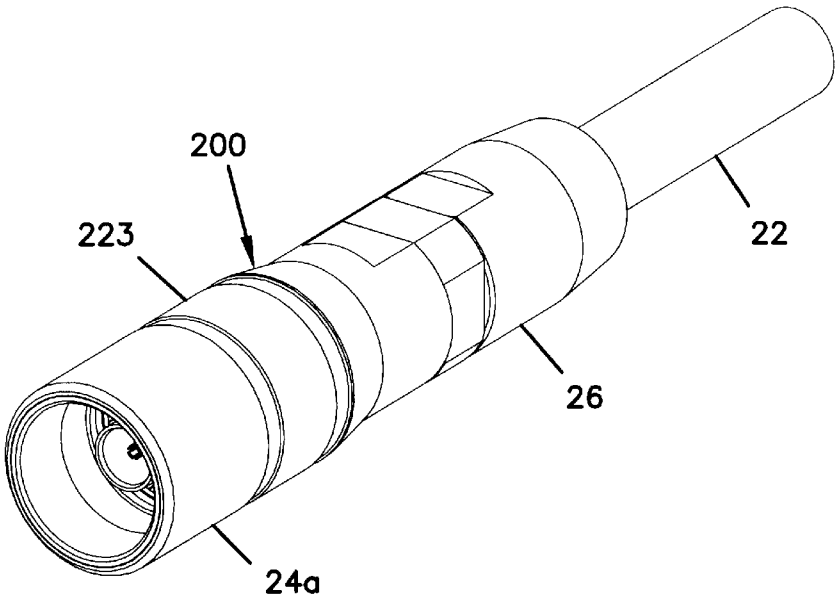
FIG. 11 is a perspective view of a triaxial female connector mounted to a cable according to another preferred embodiment of the present invention.
Figure 12:
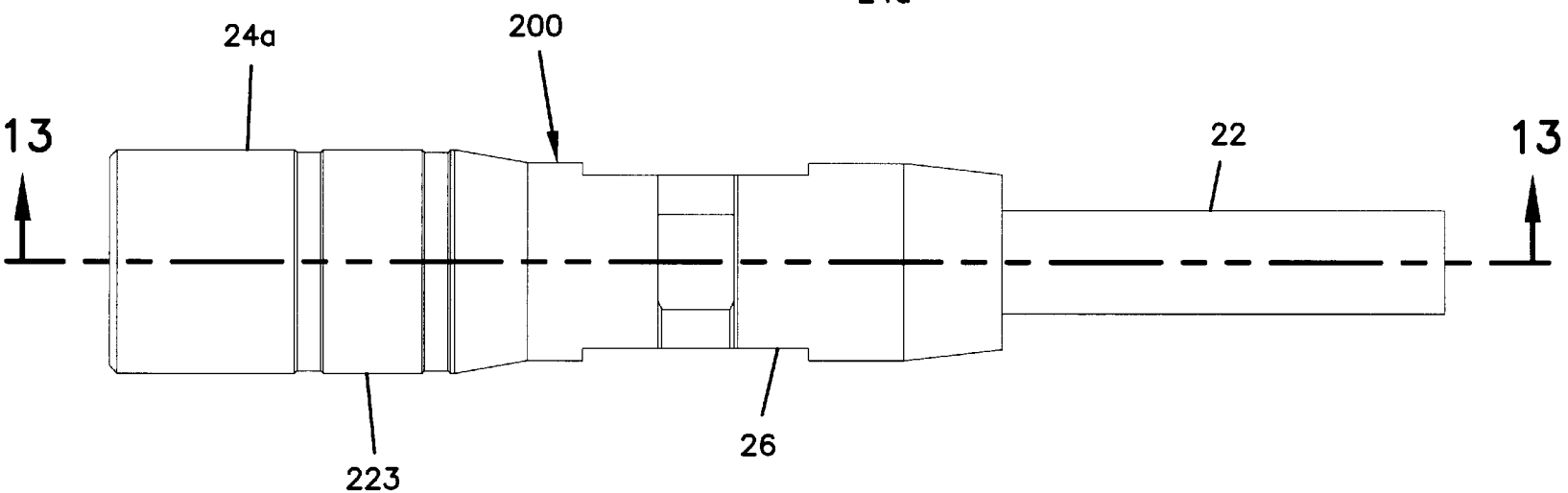
FIG. 12 is a side view of the connector and cable of FIG. 11.
Figure 14:
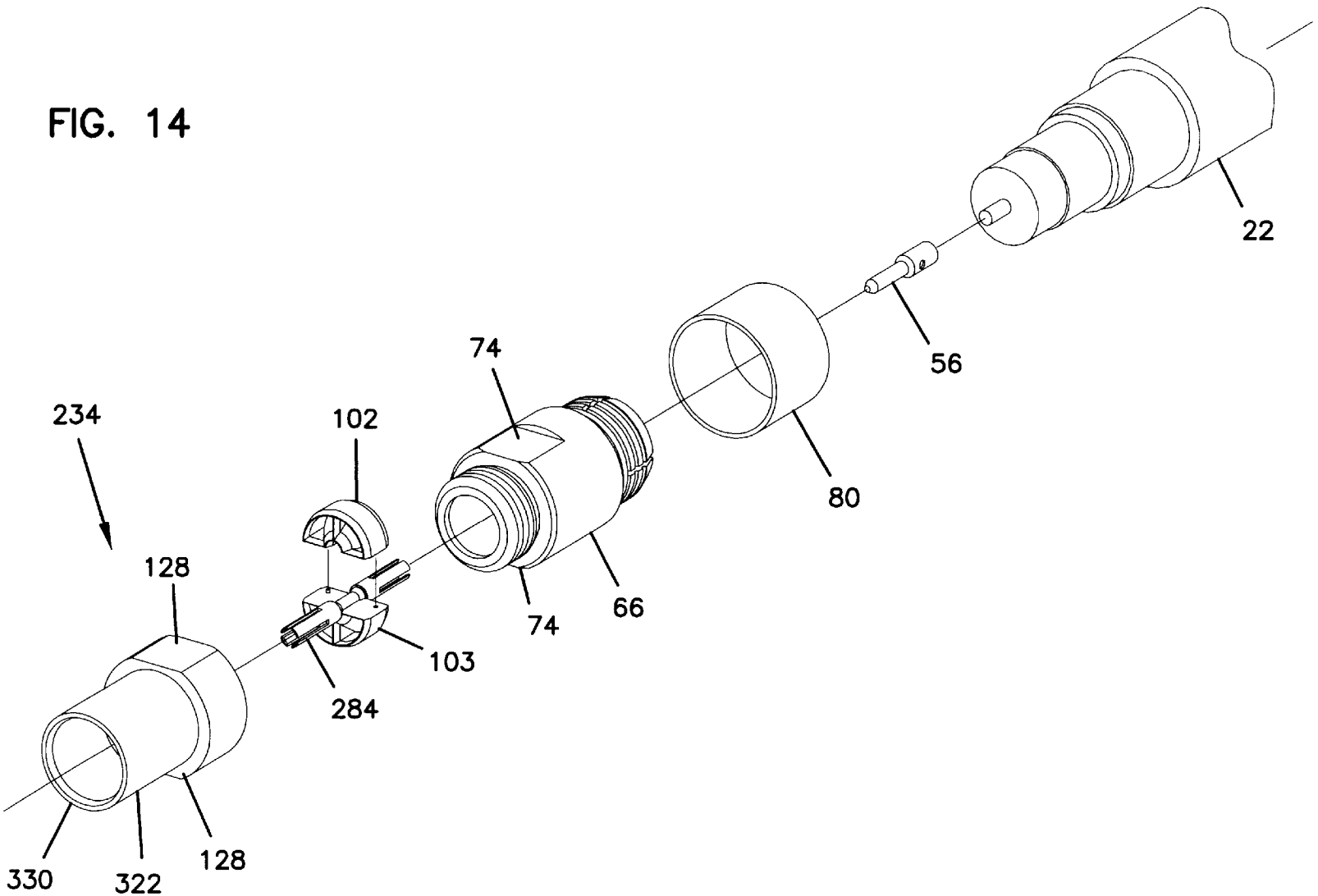
FIG. 14 is an exploded perspective view of the inner connector assembly of the connector of FIG. 11 and the cable.
Figure 15:
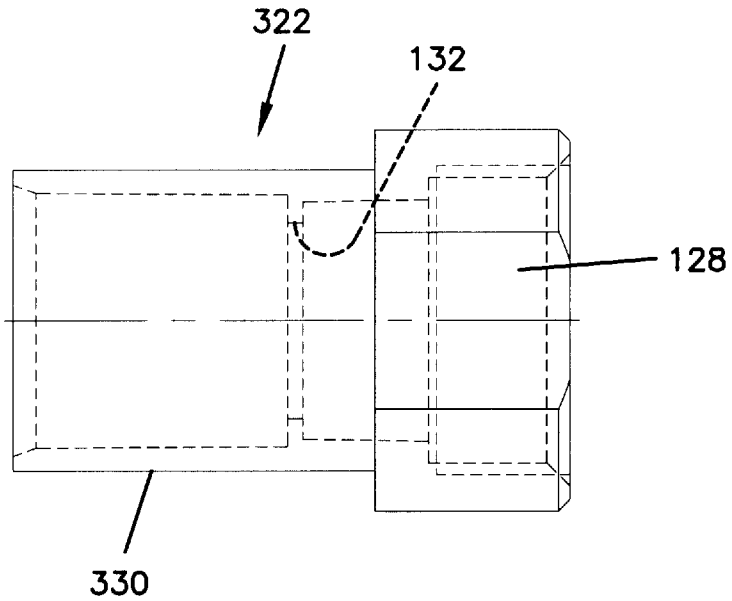
FIG. 15 is a top view of the front outer sleeve of the connector of FIG. 11.
Figure 16:
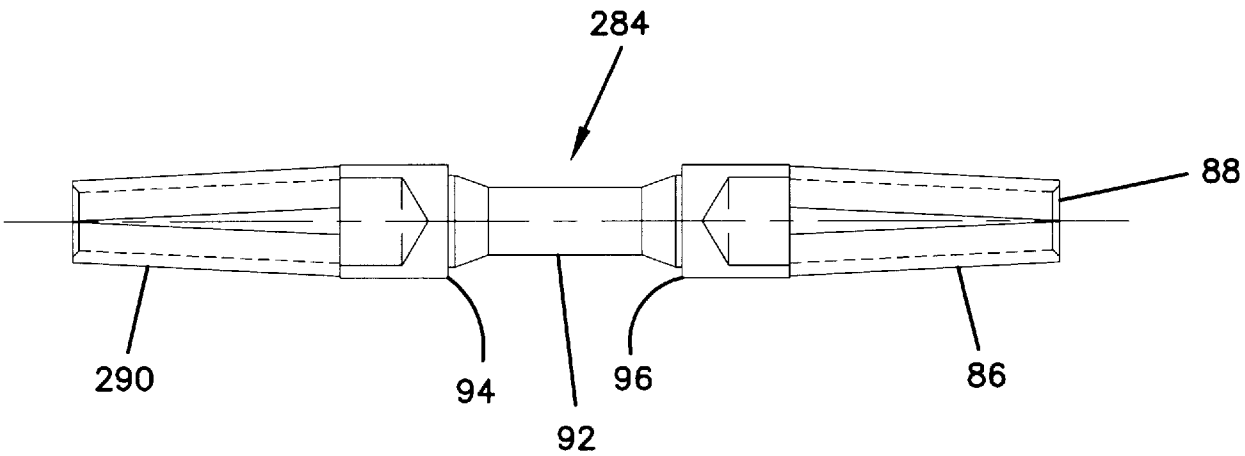
FIG. 16 is a top view of the front center conductor of the connector of FIG. 11.

It is certified that error appears in the above-identified patent and that said Letters Patent is hereby corrected as shown below:

Drawings,
Drawing sheet 5 of 8, fig. 13, should be deleted to be replaced with, Fig. 13 as shown below:

FIG. 13

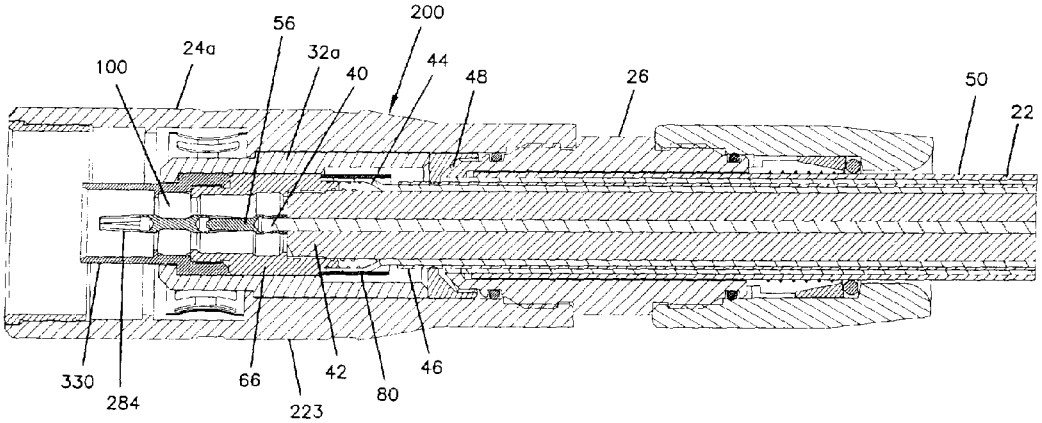

Signed and Sealed this

Twenty-second Day of October, 2002

*Attest:*

*Attesting Officer*

JAMES E. ROGAN
*Director of the United States Patent and Trademark Office*